US008276887B2

(12) United States Patent
Mann

(10) Patent No.: US 8,276,887 B2
(45) Date of Patent: Oct. 2, 2012

(54) BUILDING ELEMENT WITH VARYING SURFACE CHARACTERISTICS

(75) Inventor: Ronald Leslie Mann, Smithfield (AU)

(73) Assignee: Gram Engineering Pty. Ltd., Smithfield (AU)

( * ) Notice: Subject to any disclaimer, the term of this patent is extended or adjusted under 35 U.S.C. 154(b) by 77 days.

(21) Appl. No.: 10/549,107

(22) PCT Filed: Mar. 17, 2004

(86) PCT No.: PCT/AU2004/000326

§ 371 (c)(1),
(2), (4) Date: Sep. 15, 2005

(87) PCT Pub. No.: WO2004/083571

PCT Pub. Date: Sep. 30, 2004

(65) Prior Publication Data

US 2006/0180801 A1 Aug. 17, 2006

(30) Foreign Application Priority Data

Mar. 17, 2003 (AU) ..... 2003901193

(51) Int. Cl.
*E04H 17/16* (2006.01)

(52) U.S. Cl. ..... 256/22; 256/21

(58) Field of Classification Search ..... 52/736.2, 52/690, 729.5, 696, 729.1, 736.1, 836, 843; 256/21, 22, DIG. 5, 19, 59, 13.1; 29/897.35, 29/897.31; 428/595, 598, 603
See application file for complete search history.

(56) References Cited

U.S. PATENT DOCUMENTS

| | | | | | |
|---|---|---|---|---|---|
| 693,560 | A * | 2/1902 | Molloy | 52/729.5 |
| 991,603 | A * | 5/1911 | Brooks | 52/729.5 |
| 2,642,269 | A * | 6/1953 | Daniel | 256/21 |
| 2,809,017 | A * | 10/1957 | Wong | 256/73 |
| 2,919,112 | A * | 12/1959 | Cofield | 256/22 |
| 2,962,263 | A * | 11/1960 | Cofield | 256/22 |
| 2,973,943 | A * | 3/1961 | Loter et al. | 256/21 |
| 3,402,254 | A * | 9/1968 | Parker et al. | 428/595 |
| 4,111,400 | A * | 9/1978 | Enoksson | 256/47 |
| 5,163,225 | A * | 11/1992 | Goleby | 29/897.35 |
| 5,501,053 | A * | 3/1996 | Goleby | 52/842 |
| 6,126,145 | A * | 10/2000 | Mohr | 256/21 |
| 6,131,362 | A * | 10/2000 | Buecker | 52/729.5 |
| D486,249 | S | 2/2004 | Mann | |
| 7,032,891 | B2 * | 4/2006 | Rowley et al. | 256/24 |

FOREIGN PATENT DOCUMENTS

| | | |
|---|---|---|
| AU | 200032541 | 5/1990 |
| AU | 200165458 | 4/2002 |
| GB | 2224528 | 5/1990 |
| GB | 2249327 A | 5/1992 |
| WO | 9611316 A1 | 4/1996 |
| WO | 9611317 A1 | 4/1996 |

* cited by examiner

*Primary Examiner* — Michael P Ferguson
(74) *Attorney, Agent, or Firm* — Pearne & Gordon LLP

(57) ABSTRACT

A building element (10) is formed from sheet material having opposite major surfaces (11, 12) that extend between longitudinal edges (13, 14). Margins of the sheet adjacent the longitudinal edges are turned out of a mid-plane of the sheet to form opposite profiled sections (15 and 16). The major surfaces (11, 12) of the building element have different surface characteristics, and one profiled section has one of the major surfaces as its outer surface, and the other profiled section has the other major surface as its outer surface.

4 Claims, 6 Drawing Sheets

BUILDING ELEMENT WITH VARYING SURFACE CHARACTERISTICS

TECHNICAL FIELD

The present invention relates to a building element made from sheet material such as sheet metal strip. The invention has been developed especially, but not exclusively as elements for use in fences and is herein described in that context. The invention, however, may be used in other applications, and is therefore not limited to that particular use.

BACKGROUND ART

Typical fences include fence posts made from timber or metal which are adapted to support barrier panels. Typically, each barrier panel comprises upper and lower rigid rails extending between the posts and in-fill means extending from rail to rail. The infill means may be impervious rigid sheet, a roll formed profiled sheet, a rigid sheet of expanded metal, a plurality of spaced apart pickets, a sheet of woven wire mesh, or other substantially planar obstruction to the passage of people or animals between the posts.

In many applications, particularly for domestic and commercial use, the fencing can be quite prominent and as such there is a continuing demand for fencing which is visually appealing but which is relatively inexpensive to manufacture.

SUMMARY OF THE INVENTION

In the first aspect, the present invention relates to a building element made from sheet material having opposite major surfaces extending between opposite longitudinal edges, margins of the sheet adjacent the longitudinal edges being turned out of a midplane of the sheet to form opposite profiled sections, wherein the major surfaces have different surface characteristics, and one profiled section has one of the major surface as its outer surface, and the other profiled section has the other major surface as its outer surface.

An advantage of the present invention is that the element is produced which, through specific profiling of the edge margins, gives it a varying surface characteristic across the element face by presenting one major surface at one profiled edge, whilst presenting the other major surface along the other edge. Using this technique, elements of varying surface characteristic can be produced which are aesthetically pleasing.

With the above arrangement at least one face has discrete bands extending along the element each of which have a different surface characteristic so as to give that face of the element a "two toned" appearance. The characteristics which may vary between the two bands may be the colour, the surface finish, the surface texture or the line.

In a particular form, the profiled sections are provided to improve the structural characteristics of the element. In one form, each of the profiled sections is formed as a substantially closed section. The advantage of this arrangement is that in a single profiling step, both the structural characteristics and the varying surface characteristics are formed in the element. This therefore enables the building element to be manufactured at a low cost as compared to an approach where the varying surface characteristic is incorporated as a separate step to forming of the element.

In one form, the element is produced from sheet metal strip and is profiled using roll formers. However it is to be appreciated that other techniques may be used to produce the element such as through a folding or stamping operation, or through a combination of any of these techniques.

To produce the element in accordance with the present invention, one edge margin is profiled in a "reverse" direction to the other edge margin, in the sense that one edge margin is turned about one major surface, whilst the other edge margin is turned about the opposite major surface.

In one form, both the profiled sections are substantially identical in cross section. Preferably, the element is generally symmetrical about a plane that extends transverse to the midplane of the sheet. With this arrangement, whilst one edge margin is profiled in the reverse direction from the other edge margin, the resulting element has a cross sectional profile which is substantially the same as if the edge margins were profiled in the same direction.

In one form, the element further comprises a web that extends between the opposite profile sections. In one form, the profiled sections extend outwardly from one side of the plane containing the web so that one face of the element is generally flat.

In one form, the element is made from a strip of steel coated with a protective coating of an alloy of aluminium and zinc. In one embodiment a further painted coating is applied to at least one of the major surfaces so that the major surfaces have different surface characteristics. If both major surfaces have a painted coating, the colours of the painted surface are different to provide the different surface characteristics.

In a further aspect, the invention relates to a building element made from sheet material having opposite major surfaces extending between opposite longitudinal edges, at least one margin of the sheet adjacent a longitudinal edge being turned out of a midplane of the sheet to form a profiled section, wherein the major surfaces have different surface characteristics, and wherein on at least one face of the building element, the profiled section has one of the major surfaces as its exposed surface, whereas an adjacent portion has the other major surface as its exposed surface.

In a further aspect, the invention relates to a fence that incorporates a building element according to any form described above. In one embodiment, the element is used as part of the barrier panel between the fence posts. In another form, the element is used as the fence posts of the fence. In yet another form, the fence construction is formed entirely from the above described elements.

BRIEF DESCRIPTION OF THE DRAWINGS

It is convenient hereinafter describe embodiments of the present invention with reference to the accompanying drawings. It is to be appreciated that the particularity of the drawings and the related description does not supersede the generality of the preceding broad description of the invention.

In the drawings.

DETAILED DESCRIPTION OF THE PREFERRED EMBODIMENTS

Figure 1:
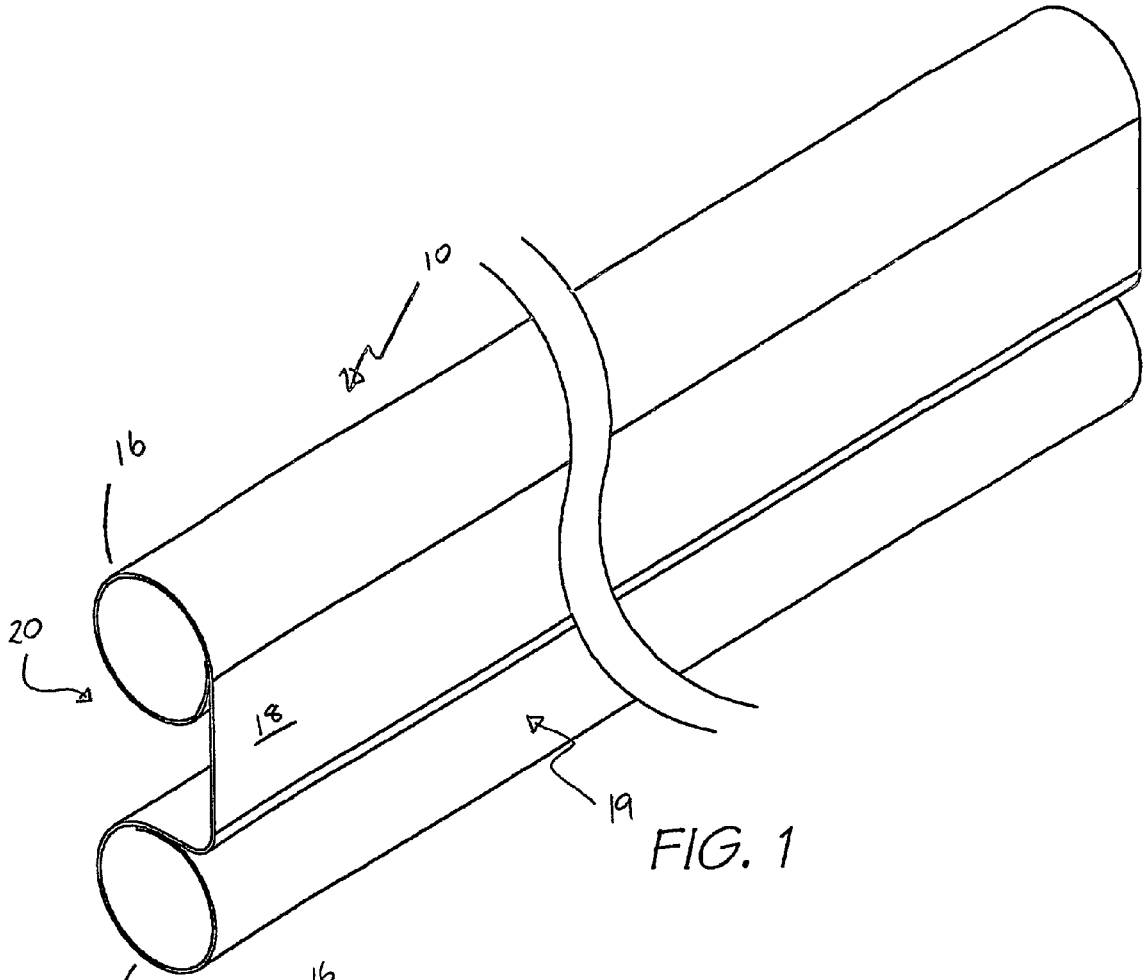
FIG. 1 is a perspective view of a building element according the a first embodiment of the present invention.
Figure 2:
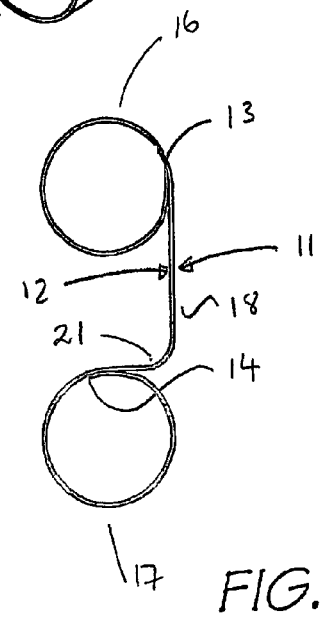
FIG. 2 is a cross section of the element of FIG. 1.

FIGS. 1 and 2 illustrate a building element 10 that is formed from sheet metal strip. The strip has opposite major surfaces 11 and 12 that extend between longitudinal edges 13,14. The opposite major surfaces 11,12 have different surface characteristics to create a variation in the appearance of the element as described in more detail below.

Typically the sheet metal strip has a protective coating of zinc and aluminium. In one form, to form the different surface characteristics on the major surfaces 11,12, a painted coating is applied to one or both of the major surfaces. If both surfaces are painted, the colours of the coatings are different. It is to be appreciated that other techniques may be used to provide the different surface characteristics. For example, the colour of both major surfaces may be generally the same, but the surface finish varying. This arrangement has particular application where the strip is stainless steel where it is possible to have a large range of finishes (i.e. gloss, satin, burnished etc.).

The element 10 is profiled (typically by passing the sheet metal strip through a roll former) to include the profiled sections 15, 16 at the margins of each of the two longitudinal edges. In the illustrated form of FIGS. 1 and 2, the profiled sections 16,17 are in the form of circular hollow sections. The element further includes a web portion 18 which is formed by a mid section of the sheet strip, and which interconnects the profiled sections 16,17.

The circular hollow sections are substantially identical and extend outwardly from one side of the web 18 so that one face 19 of the element is generally flat whereas the other face 20 has the profile sections 16,17 projecting from the web 18.

As best illustrated in FIG. 2, the element 10 has one edge margin profiled in a "reverse" direction to the other edge margin. With this arrangement one of the profiled sections 16 is turned about one of the major surfaces 12, whereas the other profiled section 17 is turned about the other major surface 11. With this arrangement, one face 20 of the element has one profiled section 16 presenting one major surface 11, whereas the other profiled section 17 presents the other major surface 12. As the major surfaces have varying surface characteristics (either by different painted coatings or the like) the element has a varying surface characteristic across each of the opposite faces 19, 20. In particular, each face has a "two toned" appearance with different coloured bands extending along the element.

A transition section 21 displaces one of the profiled section 17 relative to the web 18 so that it aligns with the other profiled section 16. This enables the element to be generally symmetrical about a plane transverse to the web 18, and to allow one face 19 to be relatively flat.

Figure 3:
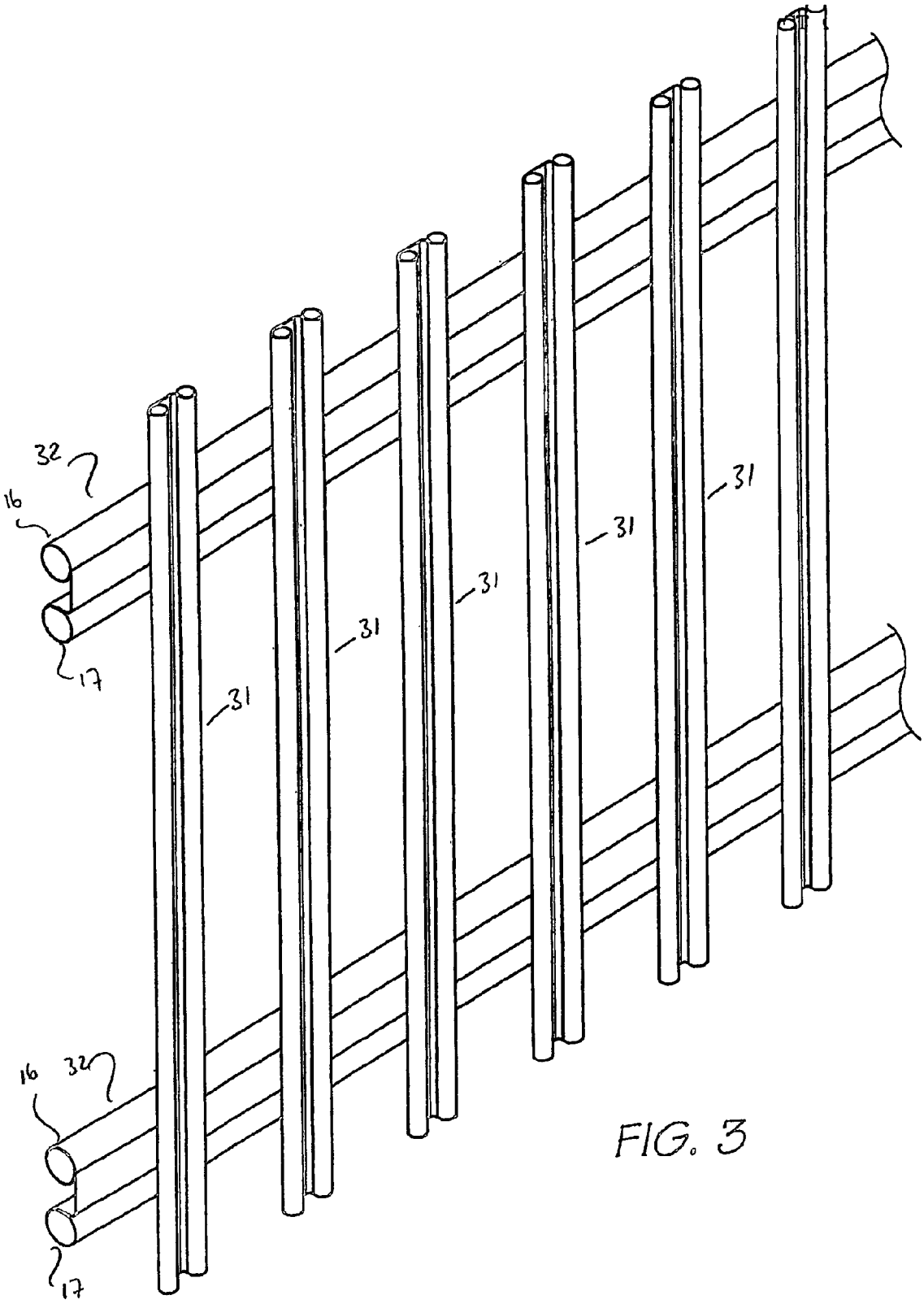
FIG. 3 is a fence formed using building elements having the profile of the element of FIG. 1.

The element 10 is ideally suited for use in fence construction as best illustrated in FIG. 3 where a picket type fence 30 is shown. In this arrangement, both the pickets 31 and the rails 32 are formed from elements having the profile as shown in FIGS. 1 and 2. To make efficient use of the material, the pickets 31 are of a smaller size than the rails 32 as illustrated in FIG. 3. The element 10 is ideally suited for this application as the profiled sections 16 and 17 provide sufficient rigidity to the element to enable it to be used as either the picket 31 or the rail 32. The elements can also be easily interconnected by being secured back to back on their respective flat faces 19. In addition, the different surface characteristics provide the two toned effect, thereby increasing the visual interest to the fence 30.

Figure 4:
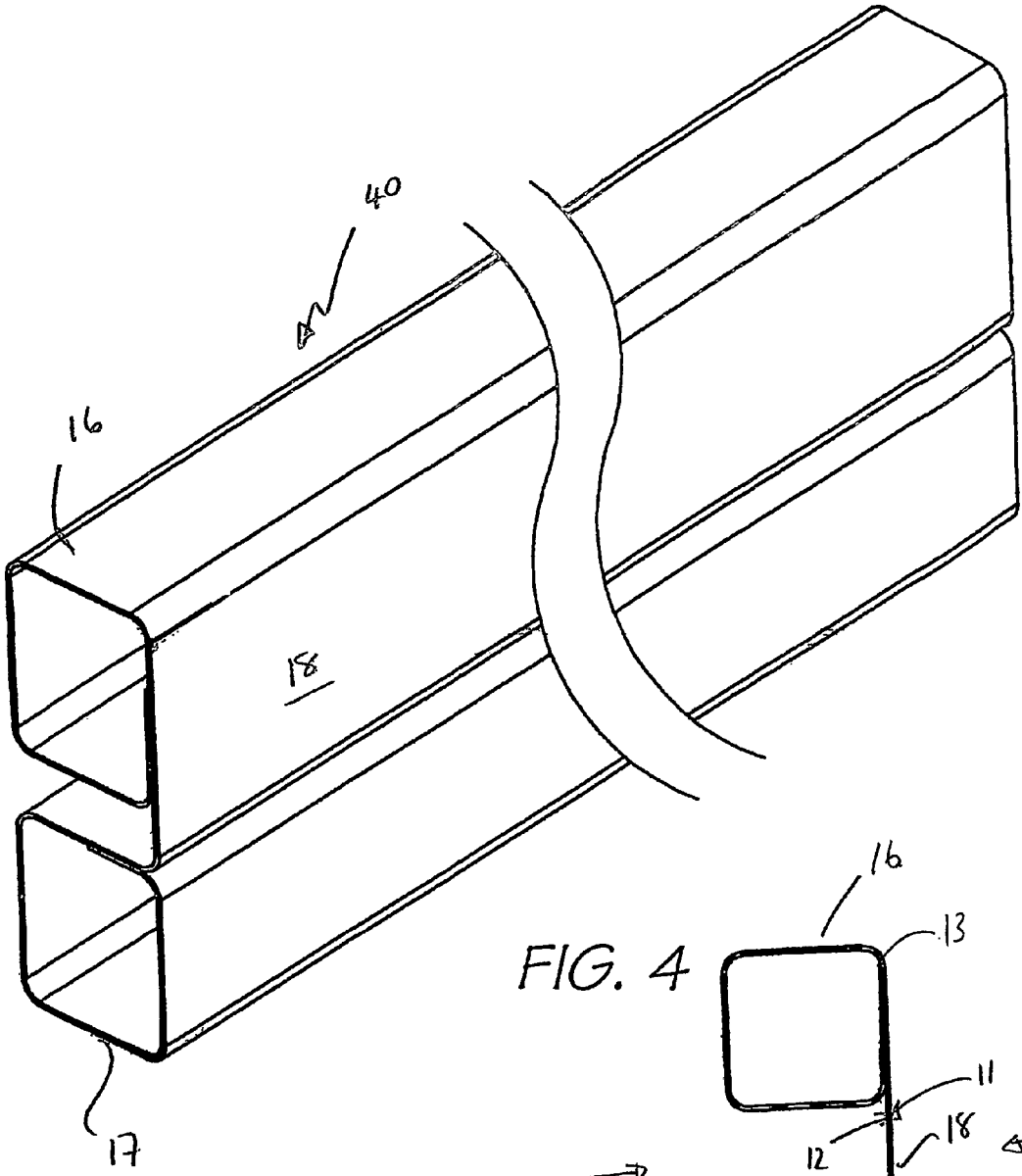
FIG. 4 is a perspective view of the building element of FIG. 1 having an alternative profile.
Figure 5:
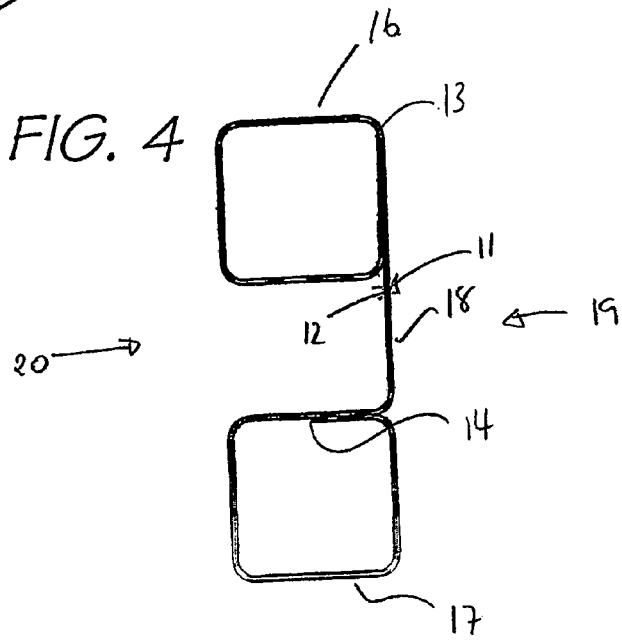
FIG. 5 is a cross section of the element of FIG. 4.

FIGS. 4 and 5 illustrate a variation in the element 10. As the element 40 of FIGS. 4 and 5 include many of the features of the element 10 disclosed in FIGS. 1 and 2, like features have been given like reference numerals. With the element 40, the sheet metal strip is profiled to form the profiled sections 16 and 17 as square hollow sections rather than as round hollow sections as shown in the earlier embodiment. In other respects the element 40 is substantially the same and in particular includes the arrangement where one edge margin is profiled in a reverse direction to the other edge margin. Again, the major surfaces 11, 12 are designed to have different surface characteristics to provide the varied appearance to the element 40.

Figure 6:
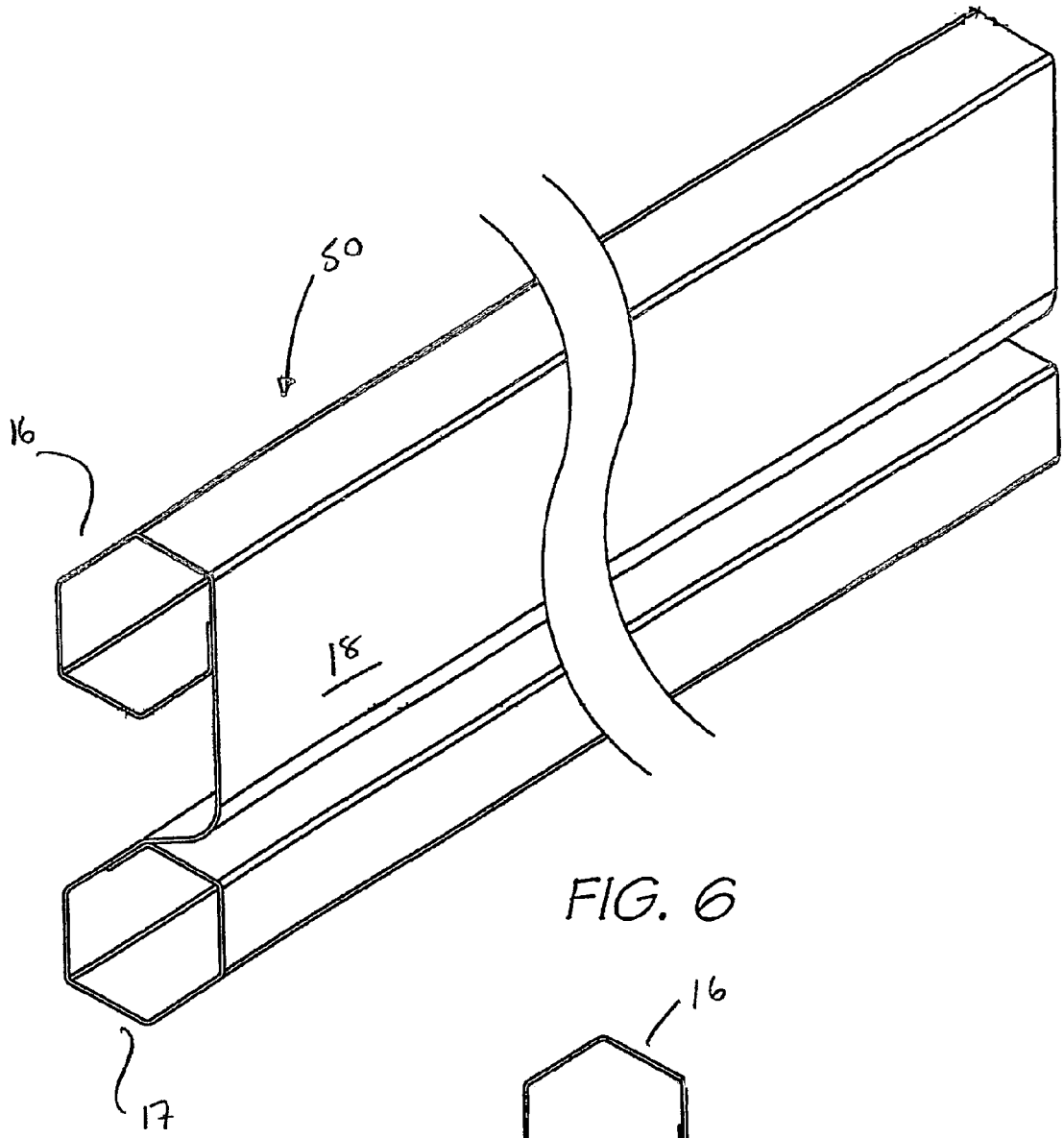
FIG. 6 is a perspective view of the building element of FIG. 1 with another alternative profile.
Figure 7:
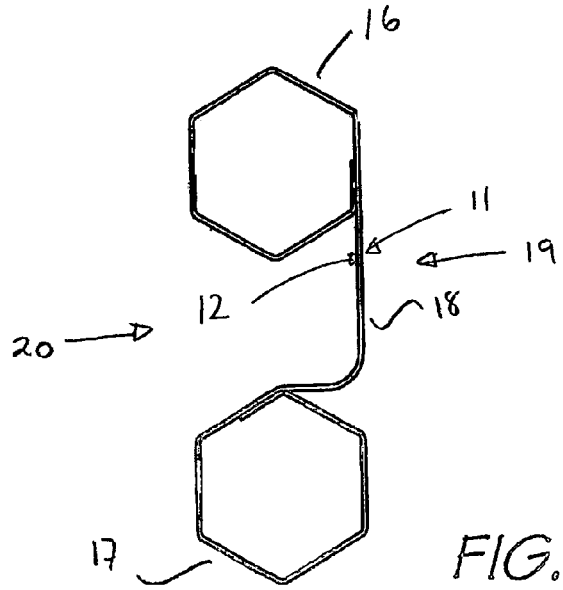
FIG. 7 is a cross section of the element of FIG. 6.

The element 50 illustrated in FIGS. 6 and 7 disclose a further embodiment where the profiled sections 16, 17 are formed as hexagonal closed section. Again, the characteristic profiling of the element is provided so that one hollow section presents a different major surface of the strip than the other profiled section 17.

Figure 8:
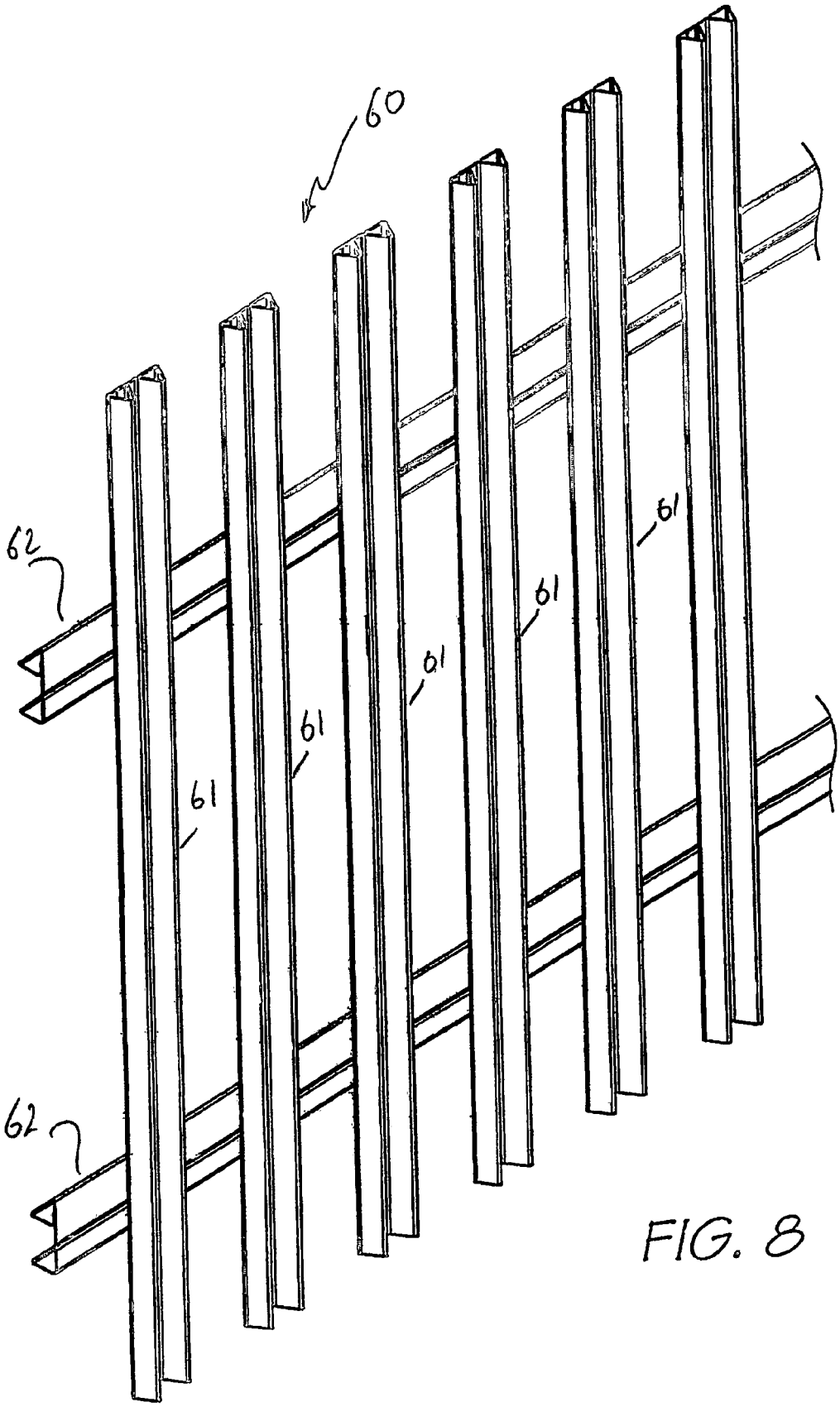
FIG. 8 is a fence using a building element according to FIG. 1 having yet a further alternative profile.

FIG. 8 illustrates a fence which is constructed using elements 61, 62 which are a further variation of that disclosed in FIG. 1. In this embodiment, the elements include hollow sections 16 and 17 formed as triangular closed sections. In other respects the elements are the same as that disclosed in the earlier embodiments.

Figure 9:
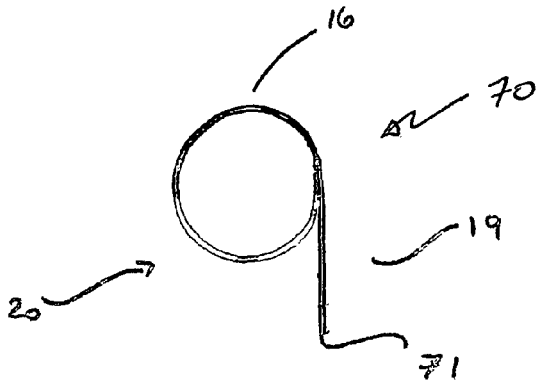
FIG. 9 to 11 illustrates modified versions of the building element of the first embodiment which incorporates a single profiled section.
Figure 10:
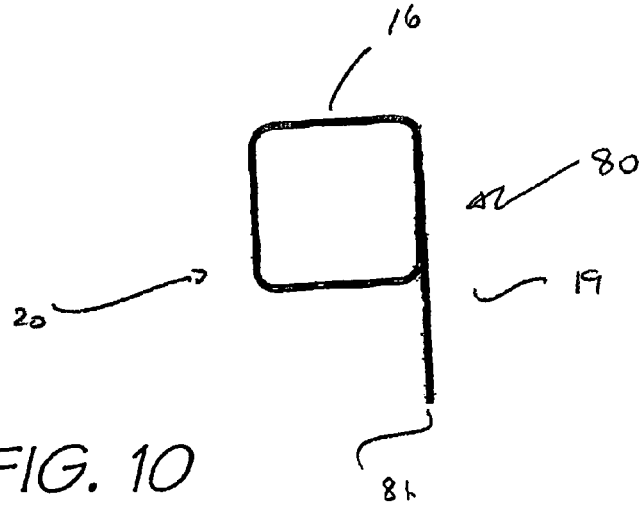
Figure 11:
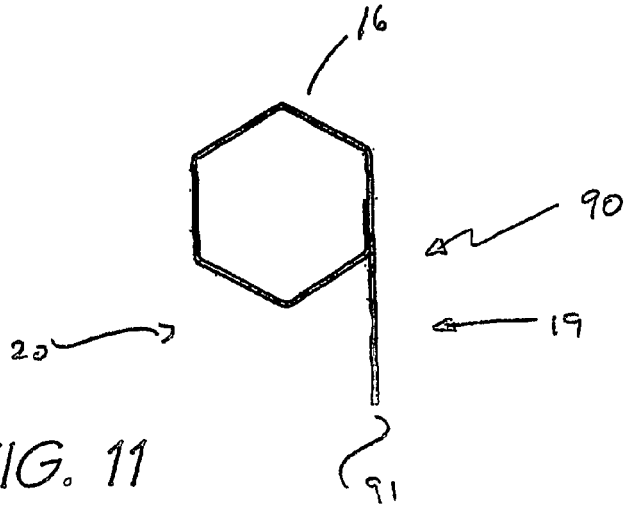

The FIGS. 9 to 11 illustrate modified versions (70, 80 and 90) of the elements 10, 40 and 50. In each of these modified versions the element has only a single profiled section 16. With this arrangement, one edge margin (71, 81,91) of each element remains as flat strip. With this arrangement, one face 19 of the element presents only one of the major surfaces 11 whereas the other face 20 presents both major surfaces thereby having a two toned effect on that face.

In a further alternative arrangement (not shown) each of the edge margins of the strip may be profiled to form a box section with each section being formed in the same direction but being spaced apart by a section web. In that arrangement, the element presents on one face (typically 20) an arrangement where there is three coloured bands with both the profiled sections presenting one of the major surfaces 11 whilst the web intermediate the profiled sections presenting the other major surface.

Accordingly, the present invention provides a building element which is made from sheet metal which is profiled so as to create rigidity in the element through the incorporation of profiled sections and also a varying surface characteristic so as to enhance the visual appeal of the element.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

Variations and/or modifications may be made to the parts previously described without departing from the spirit or ambit of the invention.

The invention claimed is:

1. A fence comprising spaced apart fence posts that are connected to one another by at least one rail, and a plurality of elongate fence elements secured in position to the at least one rail forming a barrier against passage across the fence, the fence elements being fence pickets, or barrier elements of a barrier panel, each said fence element being formed from a single sheet of material having opposite major surfaces extending between opposite longitudinal edges, and margins of the sheet adjacent the edges form opposite longitudinal first and second hollow closed profiled sections, the two major surfaces having different surface characteristics so as to provide a different visual appearance of one major surface compared to the opposite major surface, the first profiled section having one of the major surfaces as its outer surface, and the second profiled section having the other major surface as its outer surface so that each face of the fence element is two-toned, wherein the fence element has a longitudinal axis and a web interconnects the first and second profiled sections along the length of the fence element, the web extending from one end of the fence element to an opposite end of the fence element, and wherein the entirety of both of the profiled sections are disposed on the same side of a notional plane of the web, and a first one of the margins of the sheet turns back on itself in one rotational direction relative to the longitudinal axis to form the first profiled section and the other said margin of the sheet longitudinally turns back on itself from the plane of the web in the same said rotational direction to form the second profiled section whereby the second profiled section lies on the plane of the web, and the fence element further includes a transition section between the web and the first profiled section, the transition section displacing the first profiled section from the plane of the web so that the first and the second profiled sections are aligned side by side with respect to one another in a further notional plane parallel to the plane of the web, and a first longitudinal channel is thereby formed in said fence element between the transition section and the first profiled section and a further longitudinal channel is formed between the first and second profiled sections in an opposite side of the fence element to the first said channel, and the web of each fence element is abuttingly secured to a flat surface of the at least one rail.

2. A fence according to claim 1, wherein the sheet material is formed from a sheet metal strip.

3. A fence according to claim 1, wherein the profiled sections are substantially identical in cross section.

4. A fence according to claim 1, wherein the profiled sections are substantially circular in cross section.

* * * * *